US007472793B2

(12) United States Patent
Berghaeuser et al.

(10) Patent No.: US 7,472,793 B2
(45) Date of Patent: Jan. 6, 2009

(54) STORAGE DEVICE FOR CONSUMPTION-DEPENDENT RECEPTION OF MEDICAMENTS

(75) Inventors: Karin Berghaeuser, Annaberg-Buchholz (DE); Karl-Heinz Buechner, Haldenstrasse 18, D-09456, Annaberg-Buchholz (DE); Bertram Fritzsch, Scheibnerstrasse 20, D-09456 Annaberg-Buchholz (DE); Andreas Schuster, Annaberg-Buchholz (DE); Tobias Schuster, Dresden (DE)

(73) Assignees: Karl-Heinz Buechner, Annaberg-Buchholz (DE); Bertram Fritzsch, Annaberg-Buchholz (DE)

( * ) Notice: Subject to any disclaimer, the term of this patent is extended or adjusted under 35 U.S.C. 154(b) by 831 days.

(21) Appl. No.: 10/497,612

(22) PCT Filed: Nov. 30, 2002

(86) PCT No.: PCT/DE02/04415

§ 371 (c)(1),
(2), (4) Date: Jun. 2, 2004

(87) PCT Pub. No.: WO03/047496

PCT Pub. Date: Jun. 12, 2003

(65) Prior Publication Data

US 2005/0023181 A1 Feb. 3, 2005

(30) Foreign Application Priority Data

Dec. 3, 2001 (DE) ..... 101 59 810

(51) Int. Cl.
*B65D 85/42* (2006.01)

(52) U.S. Cl. ..... 206/535; 206/499; 206/815

(58) Field of Classification Search ..... 206/528, 206/535, 536, 538, 539, 499, 775, 776, 815
See application file for complete search history.

(56) References Cited

U.S. PATENT DOCUMENTS

| | | | | |
|---|---|---|---|---|
| 2,710,694 A * | 6/1955 | Carr | 211/76 |
| 4,889,238 A * | 12/1989 | Batchelor | 206/535 |
| 5,558,229 A | 9/1996 | Halbich | 206/534 |

FOREIGN PATENT DOCUMENTS

| | | |
|---|---|---|
| DE | 296 10 951 U1 | 10/1996 |
| DE | 198 56 491 C2 | 6/2000 |
| GB | 2122578 | 1/1984 |
| WO | WO 99/02118 | 1/1999 |

* cited by examiner

*Primary Examiner*—Jacob K Ackun, Jr.
(74) *Attorney, Agent, or Firm*—Christa Hildebrand; Norris McLaughlin & Marcus, PA

(57) ABSTRACT

A storage device which is suitable for presorting and having ready medicaments, particularly solid medicaments, and which is adapted to the medically prescribed, individual intake rhythm of the corresponding patients in such a way that the right dose can be administered at prescribed times without any problem. The storage device is in the form of magazines in which several receptacles (B) are stacked in semi-inclined position in a receiving container (A).

10 Claims, 8 Drawing Sheets

STORAGE DEVICE FOR CONSUMPTION-DEPENDENT RECEPTION OF MEDICAMENTS

BACKGROUND OF THE INVENTION

1. Field of the Invention

The invention relates to a storage device which is suitable so to pre-sort, and keep in a state of readiness, medication, especially medication in solid form, in proportion to the medically prescribed individual rhythm of consumption of any given patient, so that its dispensing in the proper dose at prescribed times can take place without any problems.

2. The Prior Art

Such storage devices are needed for storing medications and for simplifying the dispensing of medicine, particularly in the care of elderly and handicapped persons. Medicine chests with different subdivisions are known for timeously making medicines available for handicapped or aged persons. In this connection, so-called blister packages deposited in inserts are used which indicate at which day of the week and at what time the corresponding medicine is to be taken.

Since with aged people the quantity of dispensed medicine is relatively high, increased demands are placed upon the caretaker responsible for the administration of the medicines.

German specification DE 296 10 951 U1 discloses a sorting container for small components, in particular medicines in tablet or capsule form, which is provided with a box-like receiving element and which may receive up to seven arrayed individual receptacles. The box-like receiving element is provided with an opening in the forward center zone of its bottom as well as with a vertical slot in its forward wall through which the forward individual receptacle may be withdrawn. Every individual receptacle is provided with a rectangular aperture wherein a sliding transparent lid is movably mounted in internal grooves near the upper edges of the longitudinal walls of the aperture.

A further container for storing articles, in particular medicines, cosmetics or jewelry is described in German specification DE 198 56 491 C2. The principal characteristic of that invention is a sliding member structured as a roller lid shutter which is operatively connected with a storage element by way of a compensating clutch. The flexible sliding member is guided in parallel internal grooves in side walls. The storage element is provided with consecutively arrayed chamber sections which are separated from each other by rigid separation webs.

A parallelepiped container of modular structure, especially for medication, is known from WO 99/02118, the pivotal lid and pivotal bottom section of which are each unilaterally connected to the rear wall of the container. The seven chamber sections of the container arranged in a parallelepiped shape are separated from each other by rigid separation webs. Moreover, for increasing the storage capacity, several containers structured as daily dosage dispensers may be connected to each other by way of a groove and tongue connection disposed at their longitudinal sides.

The subject of U.S. Pat. No. 5,558,229 is a container structured as a weekly dosage dispenser receiving vertically arranged daily dosage dispensers with the front wall as well as the sidewalls which extend to about half the depth of the daily dosage dispenser being open. The individual daily dosage dispensers which are divided into up to four compartments can be taken out of the weekly dosage dispenser from the front thereof. Each of the individual compartments of the daily dosage dispensers can be separately opened by transparent lids. Arresting and guidance of the individual daily dosage dispensers within the weekly dosage dispenser are accomplished by abutments at the interior wall of the container.

Also, prior art British specification 2,122,578 A discloses a parallelepiped container for receiving several vertically arrayed individual containers and enclosing them at every side by its lateral sides. The essence of the invention resides in a vertically slidable front cover being provided with cut-out section through which containers may be removed one at a time. In a preferred embodiment, the individual containers are removed at the upper section of the receiving container by a spring element provided with a connected relatively movable bottom portion. Once a container has been removed, the container following next in the array is moved to the cut-out section by the bias of the spring.

OBJECT OF THE INVENTION

It is an object of the invention to develop a novel storage device with containers structured and arranged such that they permit easy visual inspection, filling and emptying for availability on a time-of-day, daily, weekly or monthly basis.

BRIEF SUMMARY OF THE INVENTION

In accordance with the invention the object is accomplished in the manner set forth in patent claims 1,5 and 8. Improvements of the invention are described in the subclaims.

In one aspect, the novel storage device in accordance with the invention is conceived as a weekly dosage device.

The weekly dosage device is structured as a magazine such several containers B are stacked in a receiving container A. At both of its end faces, the receiving container A is at least partially open and houses, supported on its bottom, containers B in the manner of a magazine, in an approximately parallel array relative to an inclined front surface and positioned on their longitudinal narrow side. The approximately identically inclined disposition of the planes of the front and rear ends is inclined away from the front end surface. Because of the inclination, a user may at all times and without impediment visually inspect the actual contents of all containers B in their stacked storage position within container A.

The containers B act as daily dosage dispensers or time-of-day dosage dispensers. Every weekly dosage dispenser (container A) contains seven daily dosage dispensers. The daily dosage dispensers (containers B) which may be filled with tablets, for instance, may be removed through the front, i.e. through the forward end surface and, once emptied, they may, in the manner of a magazine, be reinserted into the weekly dosage dispenser through its rear end.

To facilitate loading of the weekly dosage dispenser with daily dosages for a weekly cycle, the upper wall which is seated on the side walls of the container A may be removable. In a preferred embodiment, the lateral margins of the upper wall and the adjacent longitudinal edges of the side walls may in that cases engage each other in such a manner that removal of the upper wall may only be done by squeezing the side walls together when the weekly dosage dispenser is empty.

A cut-out is provided between the front end surface or between the plane of the front end surface of the weekly dosage dispenser and the leading edge of the upper wall. The cut-out makes it possible to grasp from above, and thus remove more easily, the leading one of the daily dosage dispensers positioned at the dispensing side and facilitates reinsertion of the given daily dosage dispenser.

In a preferred embodiment, the cut-out is restricted to the center area, and at both marginal sides adjacent to its center section, the upper wall is extended to the forward end face in the manner of a flexible web or tongue-like spring element. The flexible webs resiliently engage the upper surface of the leading container B and ensure that the leading daily dosage dispenser available for removal from the magazine is retained with sufficient force.

At the rear end surface of the weekly dosage dispenser, there is provided a wall extending to about half the height of the container and engaged by the bottom portion of the trailing daily dosage dispenser.

The geometry of the containers B or daily dosage dispensers is structured such that their length corresponds to the width of the container A (weekly dosage dispenser) so that "charging of the magazine" takes place by stacking the daily dosage dispensers in the weekly dosage dispenser in a transverse orientation.

Each daily dosage dispenser consists of a bottom portion and a preferably transparent lid portion which may be removed from the bottom portion or may be structured to slide over the bottom portion in a longitudinal direction. When joining the two components, the longitudinal transverse margins of the lid portion extend over the wall of the body of the bottom portion.

The bottom portion of the daily dosage dispenser is structured with a curved wall, and separation webs are provided in the bottom portion for forming separated deposit chambers.

These separation webs positioned transversely on the bottom portion subdivide each daily dosage dispenser into at least five compartments such that tablets may, for instance, be placed in them for "morning", "noon", evening", "night time" and "as required" use. The lids may be labeled correspondingly.

The storage device may also be structured as a monthly dosage dispenser. A monthly dosage dispenser consists of a housing with several trays or drawers positioned in the container C or monthly dosage dispenser.

Each drawer is provided with at least one receiving frame or with an exchangeable box-like insert provided with a receiving frame for receiving the containers B which would in this example be daily dosage dispensers or time-of-day dosage dispensers. In this arrangement, the containers B are positioned on their longitudinal narrow sides within the receiving frame of the drawers.

For four weeks, a monthly dosage dispenser is provided with at least 112 daily dosage dispensers or time-of-day dosage dispensers, and the inserted daily dosage dispensers or time-of-day dosage dispensers are provided with markings (color, PIN, and the like) indicative of a day or the like. Adjacent to the receiving frame for storing the containers B, the bottom section of the drawers or the box-like inserts may be provided with recesses for inserting tubes, bottles, blisters, directions of use, auxiliary means and the like.

A particular characteristic of the drawer is that it may be withdrawn from the housing almost entirely, except for a few millimeters, and that toward the end of its withdrawal it may be tilted downwardly by several centimeters. This allows a user to insert his hand even into the rearmost portion of the drawer. The special movability of the drawer is made possible by abutments positioned at the rear surface of the drawer which upon full withdrawal of the drawer engage corresponding abutments disposed at the forward housing frame. For ensuring the downward tilting of the drawer, the terminal portion of the groove in which the drawer is sliding is widened progressively so that as a result of the increasing play runners sliding in the groove and the drawer may be lowered.

In its basic structure, a monthly dosage dispenser contains five drawers such as, preferably, four small drawers and one large drawer. The chutes of the drawers in the housing of the monthly dosage dispenser may be designed to allow a large drawer to be exchanged for two small ones.

The monthly dosage dispensers may be provided with a locking feature for blocking one, several or all of the drawers. A handle may also be provided to facilitate transportation. The monthly dosage dispensers may be stackable; they may be connected to each other, placed on shelves or in cabinets, and they may be hung on a wall.

DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DETAILED DESCRIPTION OF THE PREFERRED EMBODIMENTS

Figure 1:
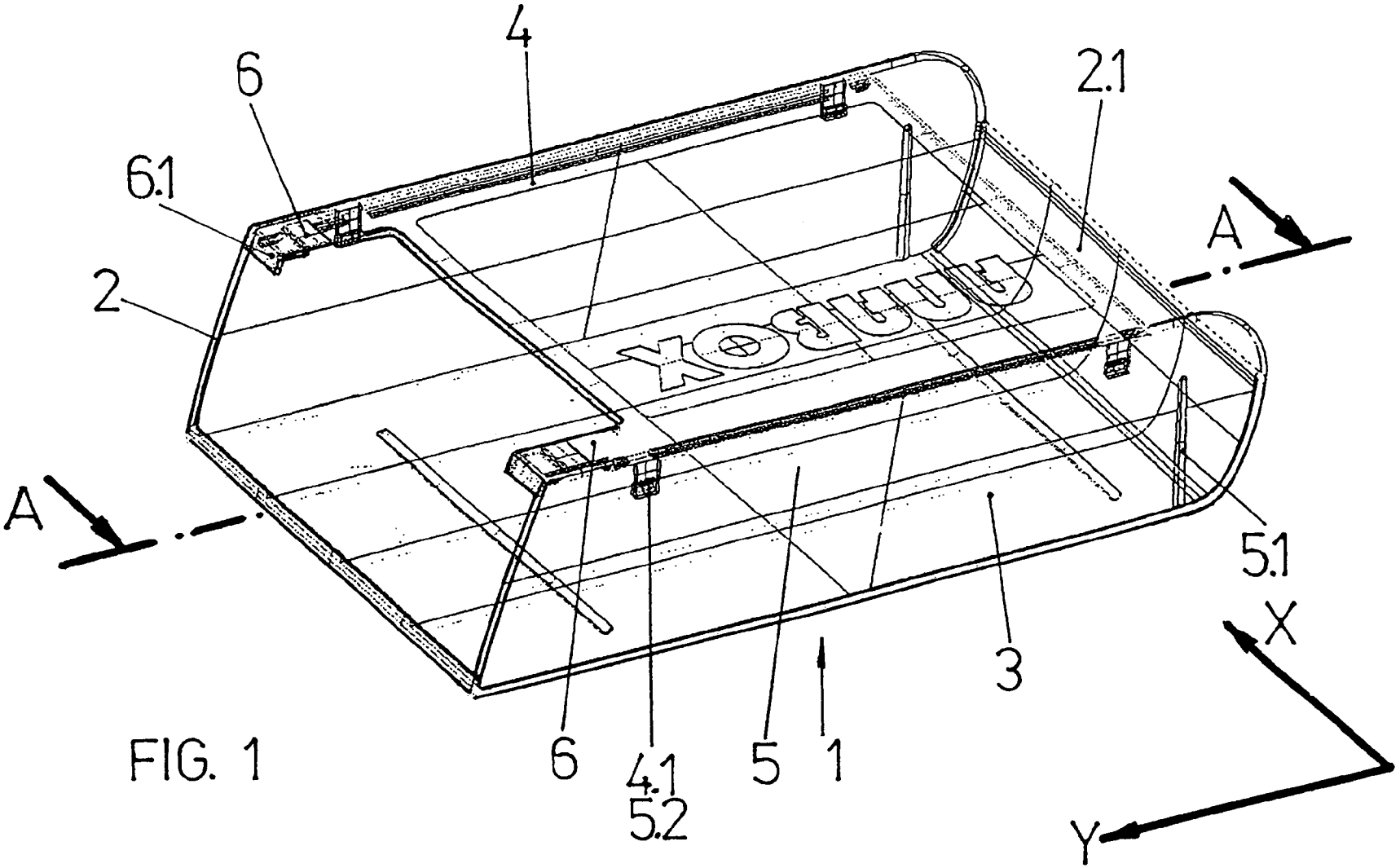
FIG. 1 is a perspective view of a complete a weekly dosage dispenser.

FIG. 1 is a total view of the weekly dosage dispenser 1. In its basic structure, the weekly dosage dispenser consists of a bottom portion 3 with side walls 5 connected thereto in rectangular alignment, an upper wall 4 which cannot be removed by the user, and two end surfaces 2 of inclined planes 2. For attaching the upper wall 4 on the side walls, the upper wall 4 is provided with two claws 4.1, and the side walls 5 are provided with two associated recesses 5.2. The claws penetrate into the correspondingly configured recesses from the interior and/or from the exterior, and thus provide a snap-fit connection.

To facilitate removal and refilling of the filled daily dosage dispenser 7 (see FIG. 2) by the patient, the forward end surface is open. At the rear end surface there is provided an outwardly curved wall 2.1 which extends to about half the height of the dosage dispenser and which supports the trailing daily dosage dispenser 7 at its matching curved bottom portion 8 (see FIG. 2).

Relative to the length of the side walls 5, the upper wall 4 of the weekly dosage dispenser 1 is shortened such that at one of the two end surfaces 2 the daily dosage dispenser 7 extended furthest may be grasped from above and drawn out in a forward direction (forward open end surface) or, at the other end surface, a daily dosage dispenser may be inserted from above (rear end surface and wall 2.1).

At the withdrawal side, the cut-out in the upper wall 4 is restricted by two lateral tongue-like spring elements 6. The spring elements 6 extend in the direction of the plane of the forward end surface 2 from extensions of the upper wall 4 and resiliently engage the top of the leading daily dosage dispenser 7. A lip 6.1 which may be provided at the forward section of the lower surface of the spring elements 6 augments any means for arresting the forward-most daily dosage dispenser 7. The force of these spring elements 6 must be overcome for removing the daily dosage dispensers 7 in a forward direction or for inserting a daily dosage dispenser 7 from the front.

For similarly arresting any trailing daily dosage dispenser 7 at the rear surface of the weekly dosage dispenser 1, a clamping element 5.1 is provided in both side walls 5. Its clamping action acts in an arresting manner on the end surfaces of the daily dosage dispenser located here (see FIG. 2). The clamping elements 5.1 may be structured as clamping lips, clamping wedges or clamping webs. Both components 5.1 ensure that regardless of the orientation of the weekly dosage dispenser 1 no daily dosage dispenser 7 can slip out through the end surfaces 2.

Figure 2:
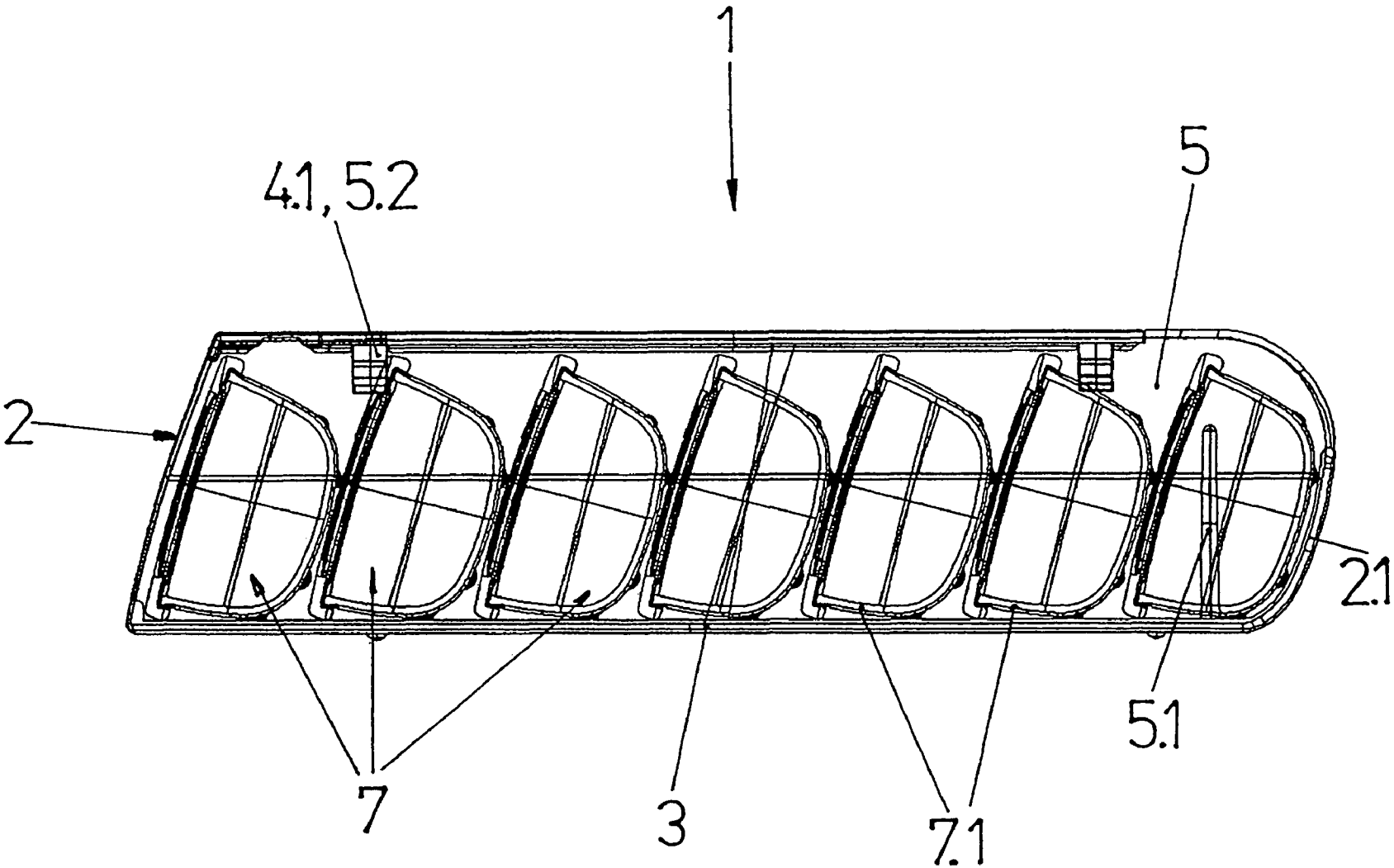
FIG. 2 is a sectional presentation along section line A-A of FIG. 1 of a weekly dosage dispenser with a "charged magazine"

FIG. 2 depicts a weekly dosage dispenser with a "magazine filled" by seven daily dosage dispensers 7. The seven daily dosage dispensers 7 are disposed in a semi-inclined orientation, approximately parallel to the plane of the end surfaces 2, with their longitudinal narrow surfaces 7.1 engaging the bottom 3 of the weekly dosage dispenser 1.

Figure 3:
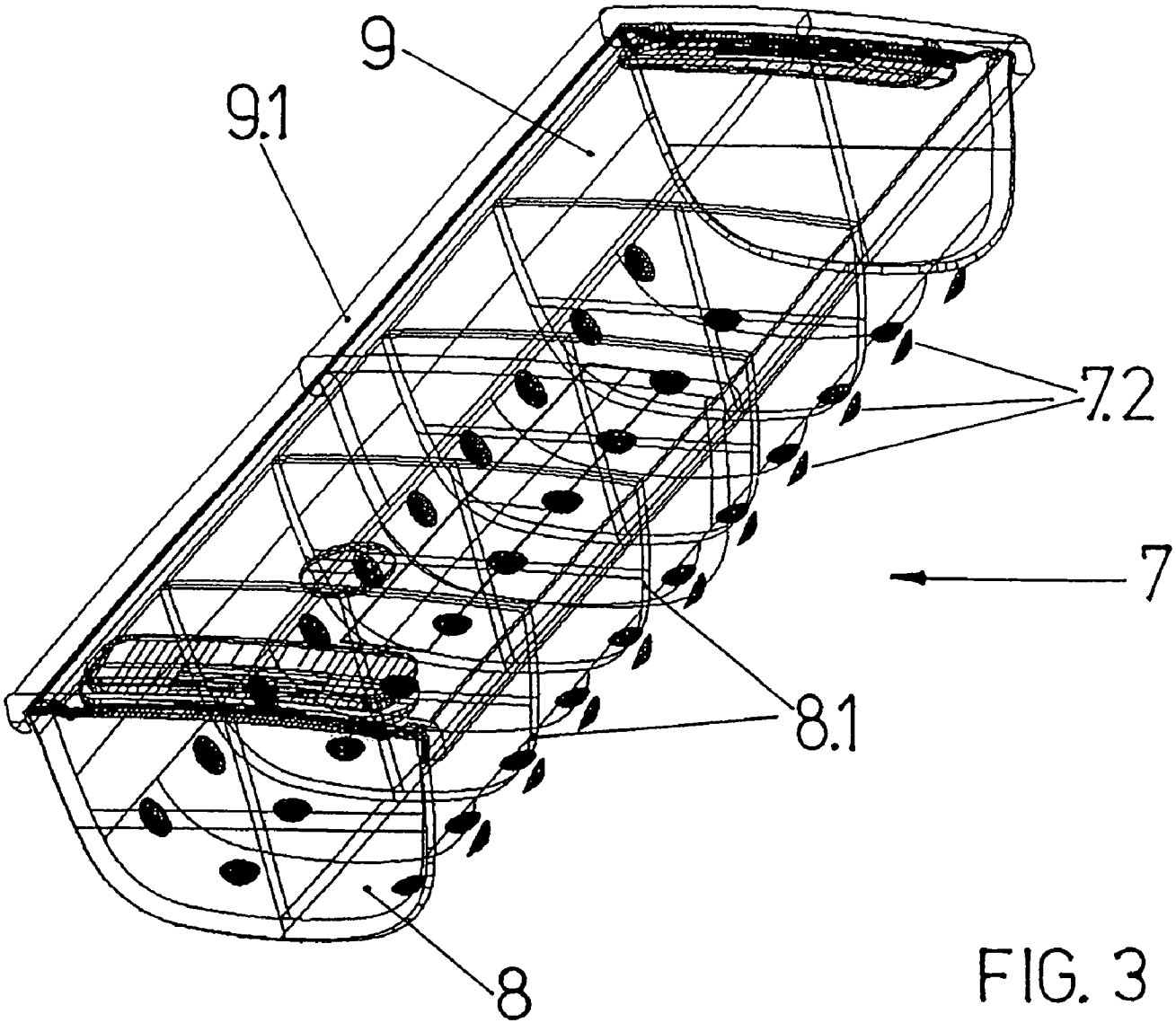
FIG. 3 is a perspective view of a complete a daily dosage dispenser.
Figure 4:
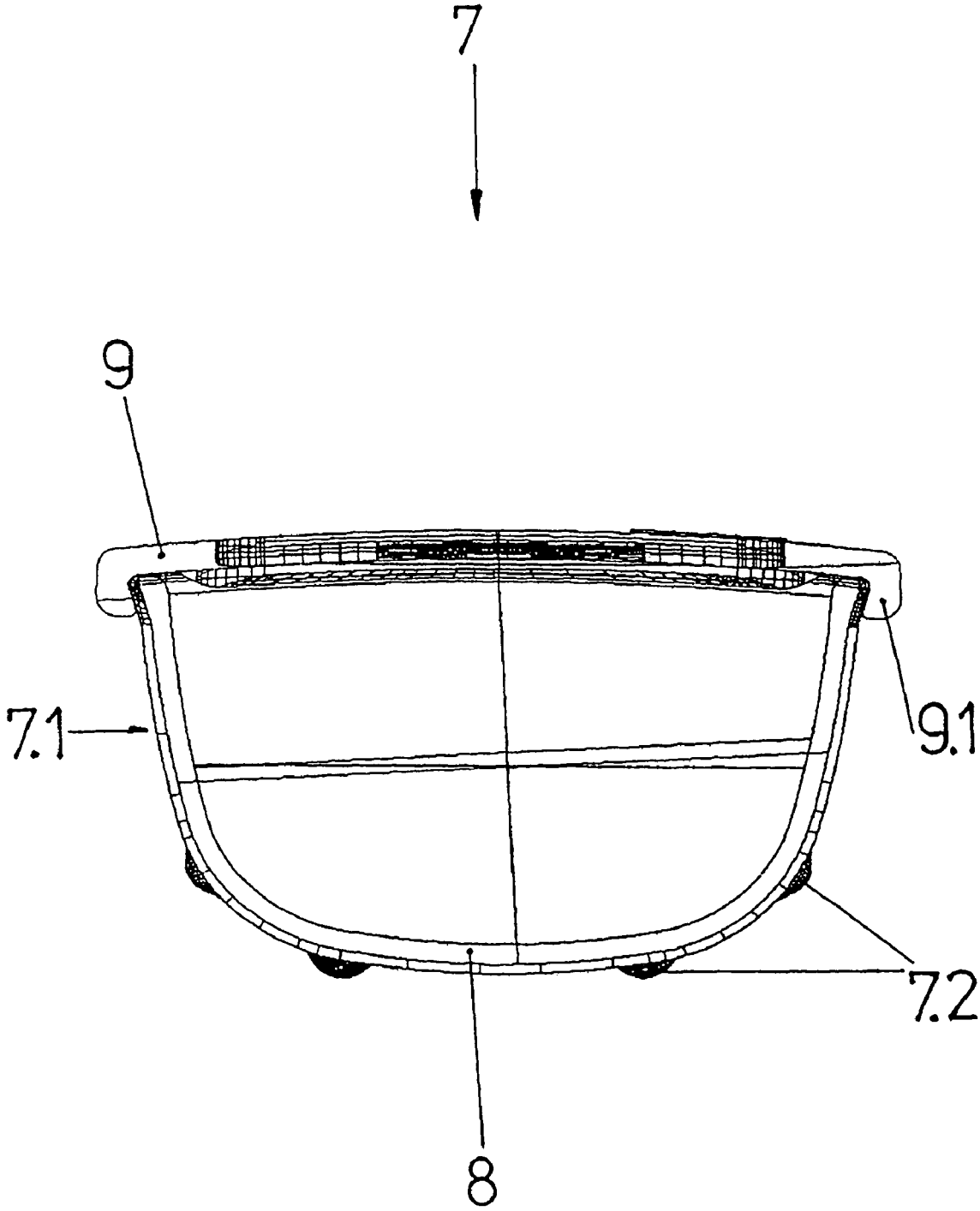
FIG. 4 is a sectional view of the daily dosage dispenser.

Each daily dosage dispenser 7 consists of a bottom portion 8 and a lid portion 9 (see FIGS. 3 and 4). When joining the two portions 8, 9, the lid portion 9, by its longitudinal side edges 9.1 extends over the wall of the bottom portion 8. The structure including such a lid portion 9 allows quick removal of the lid by a simple click and subsequent (renewed) refilling of the daily dosage dispenser. The separation webs 8.1 integral with the bottom portion 8 form the desired number of storage chambers for the daily dosage dispensers 7. By sliding the lid portion 9 along the bottom portion 8, the storage chambers are sequentially exposed. Knobs 7.2 distributed over the external surface of the bottom portion 8 improve the position of the daily dosage dispensers 7.

Figure 5:
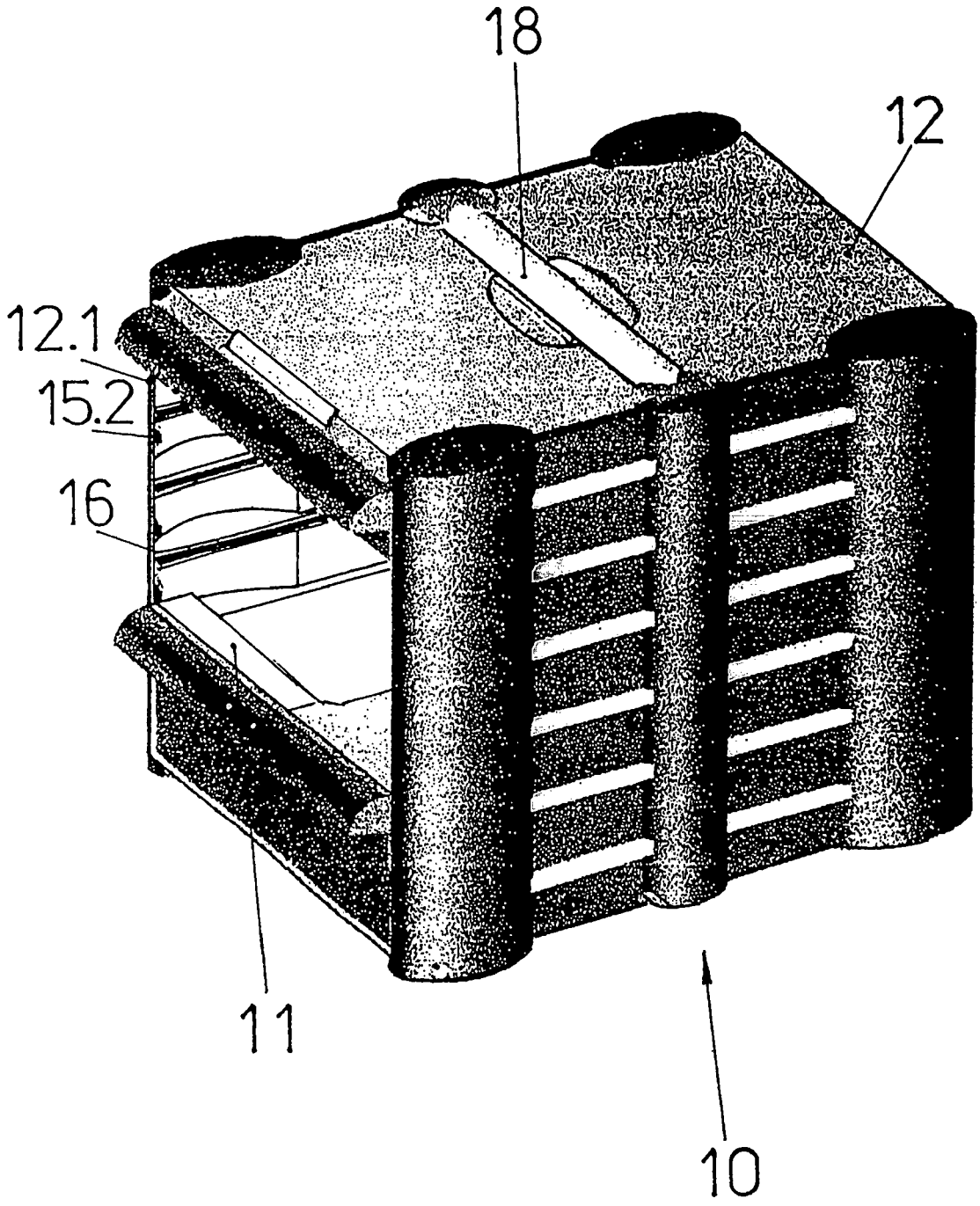
FIG. 5 is a perspective view of a complete monthly dosage dispenser.
Figure 6:
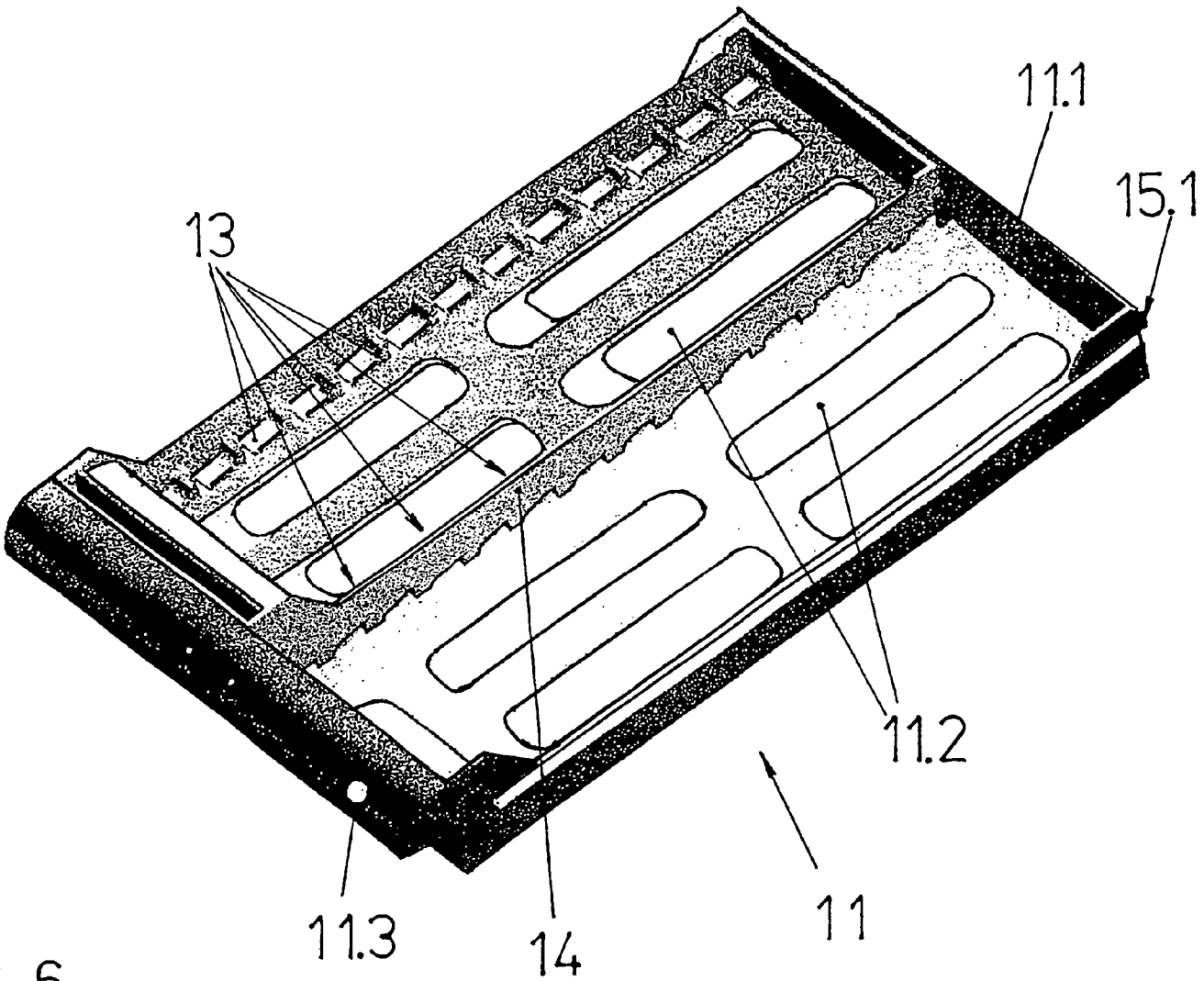
FIG. 6 Is an overall view of a drawer for a monthly dosage dispenser.

FIG. 5 shows a stackable monthly dosage dispenser 10 in a structure suitable for transport, with a handle element 18 which may be recessed into the housing. In its basic structure, the monthly dosage dispenser 10 shown consists of a housing 12 with four inserts structured as drawers 11. As a rule, two removable box-like inserts 14 may be placed in each drawer 11. Each drawer 11 or each insert 14 is provided with at least one receiving frame 13 for accepting, in a semi-inclined orientation, the daily dosage dispensers and/or time-of-day dosage dispensers 7. The support surfaces of the receiving frame 13 are of curved configuration which complements the bottom portion 8 of the daily dosage dispenser 7.

Openings 11.2 are provided in the bottom portion of the drawers 11 and of the inserts 14. The openings 11.2 overlap, so that once a drawer 11 has been withdrawn, any tubes, bottles, blisters and the like stored in the daily dosage dispensers and/or time-of-day dosage dispensers 7, may be grasped through openings 11.2 from below for augmenting or facilitating their removal. Each insert 14 usually is provided with receiving frames 13 arranged in pairs or at both sides for supporting the two ends of the daily dosage dispensers and/or time-of-day dosage dispensers 7.

Marking fields 11.3 serve to simplify the arrangement and dispensing of medication and may be provided at the handle side of the drawers as well as on the daily dosage dispensers and/or time-of-day dosage dispensers 7.

Because specially structured runners, the drawers 11 may be almost completely withdrawn from the housing 12 and tilted downwardly by up to about 30° relative to the horizontal plane. In this manner, unimpeded access is possible to the most rearward sections of the drawer 11. Structure and function of this constructive arrangement is apparent from FIGS. 7 and 8.

Figure 7:
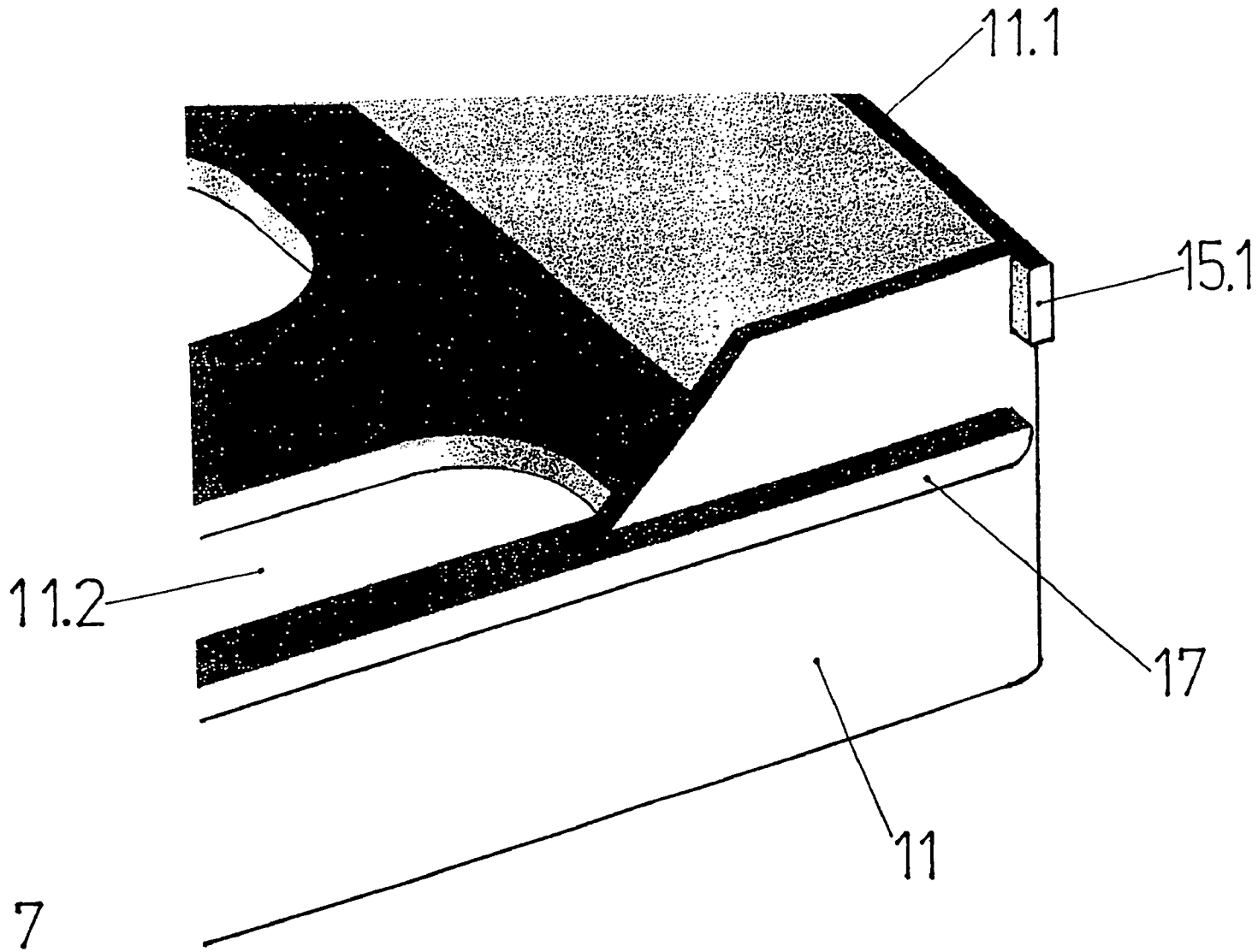
FIG. 7 is a sectional view of the drawer.

FIG. 7 depicts a section of the drawer 11 showing an abutment 15.1 at the rear surface of the drawer 11.1.

Figure 8:
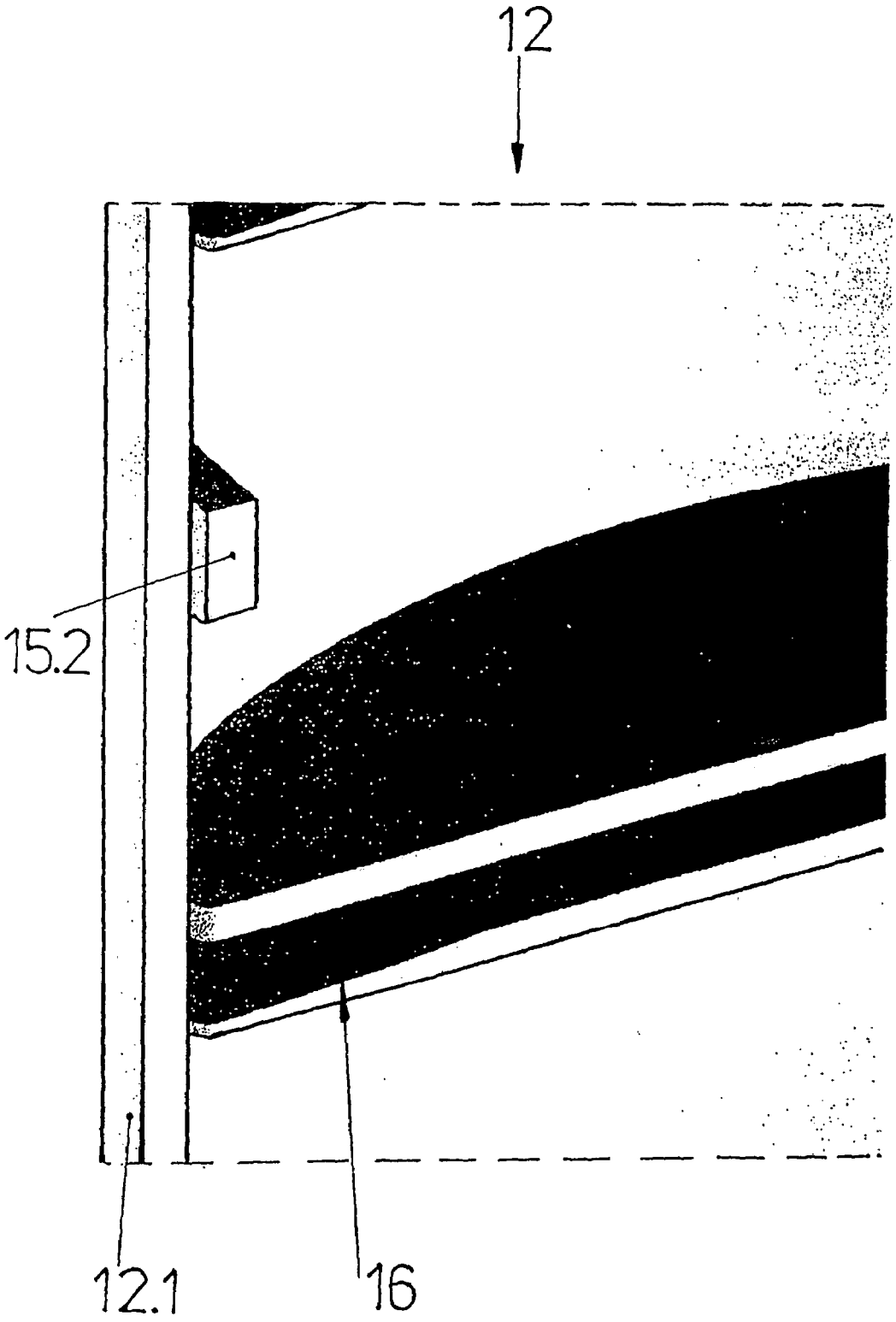
FIG. 8 is a sectional view of the slide of the drawer.

FIG. 8 depicts the front side (side of insertion) of the housing frame 12.1 provided with a corresponding abutment 15.2 which upon withdrawal of the drawer 11 is engaged by the abutment 15.1 at the rear surface of the drawer. The downward tilting movement of the drawer 11 sliding on runners 17 in associated grooves 16 is made possible by the shown progressive widening of the groove.

The invention claimed is:

1. A storage device for consumption-dependent reception of medication comprising:

a weekly dosage dispenser having a housing extending in x-y planes; a bottom and an upper wall which are connected to each other by side walls, the upper wall being positioned on the side walls which extend in the y direction and interlocking therewith; the weekly dosage dispenser further including a front end surface defining an inclined plane and an opposite rear end surface with access openings at both end surfaces;

a plurality of daily dosage dispensers disposed interior of the housing, adjacent to each other and aligned longitudinally of the access openings, each daily dosage dispenser including a bottom portion and a lid portion, the daily dosage dispensers being individually removable through the access openings, wherein between the inclined plane of the front end surface and a leading edge of the upper wall there is provided a cut-out through which a leading one of the plural daily dosage dispensers may be grasped for easier removal, and an approximately half-height wall at the rear end surface is curved to ensure a semi-inclined position of the daily dosage dispensers which matches a curvature of the bottom portion of the daily dosage dispenser and that a degree of inclination of the daily dosage dispensers corresponds to the inclined plane of the front surface of the weekly dosage dispenser.

2. The storage device according to claim 1, wherein the cut-out at the leading edge of the upper wall of the weekly dosage dispenser is restricted to a center section and that at both marginal sections extending from the center section the upper wall in the y direction is provided with elements resiliently engaging an upper longitudinal edge of the leading daily dosage dispenser.

3. The storage device according to claim 2, wherein in their forward section closest to the end surfaces, the elements are provided with a lip.

4. The storage device according to claim 1, further comprising a clamping element provided in both side walls which by its clamping effect acts clampingly on both side walls arresting a trailing daily dosage dispenser at the rear end of the weekly dosage dispenser.

5. The storage device according to claim 1, wherein the bottom portion of the daily dosage dispenser pointing to the rear end surface of the weekly dosage dispenser is provided with a curved wall matching the half-height wall and that by its longitudinal side edges the lid portion of the daily dosage dispenser has longitudinal side edges that extend over the bottom portion.

6. The storage device according to claim 5, further comprising knobs applied exterior to the bottom portion of the daily dosage dispenser for improving placement.

7. The storage device according to claim 1, wherein the plural daily dosage dispensers comprise seven daily dosage dispensers positioned in the weekly dosage dispenser on the bottom in a magazine-like manner in a semi-inclined orientation on longitudinal sides substantially parallel to planes defined by the end surfaces of the weekly dosage dispenser.

8. The storage device according to claim 1, wherein the medication is in a solid medication state.

9. The storage device according to claim 2, wherein the elements are one of flexible webs and tongue-like spring elements.

10. The storage device according to claim 4, wherein the clamping elements are one of clamping lips, clamping wedges and clamping webs.

* * * * *